US012465825B2

(12) United States Patent
Goserud

(10) Patent No.: US 12,465,825 B2
(45) Date of Patent: Nov. 11, 2025

(54) GOLF TEE WITH AIR CHANNEL

(71) Applicant: J. Thomas Goserud, Landisville, PA (US)

(72) Inventor: J. Thomas Goserud, Landisville, PA (US)

( * ) Notice: Subject to any disclaimer, the term of this patent is extended or adjusted under 35 U.S.C. 154(b) by 0 days.

(21) Appl. No.: 18/432,906

(22) Filed: Feb. 5, 2024

(65) Prior Publication Data

US 2024/0261645 A1 Aug. 8, 2024

Related U.S. Application Data

(60) Provisional application No. 63/483,890, filed on Feb. 8, 2023.

(51) Int. Cl.
*A63B 57/10* (2015.01)

(52) U.S. Cl.
CPC ..... *A63B 57/10* (2015.10); *A63B 2225/01* (2013.01)

(58) Field of Classification Search
CPC ..... A63B 57/10; A63B 2225/01
See application file for complete search history.

(56) References Cited

U.S. PATENT DOCUMENTS 1,627,012 A * 5/1927 Copeland ..... A63B 57/10 473/394
4,838,285 A * 6/1989 Petrone ..... A63B 57/10 473/282
5,683,313 A * 11/1997 Disco ..... A63B 57/19 473/387
6,849,008 B1 * 2/2005 Wang ..... A63B 57/10 473/401
7,052,416 B2 * 5/2006 Chang ..... A63B 57/10 473/396
D592,713 S * 5/2009 Schneider ..... D21/717
8,092,321 B2 * 1/2012 Chiang Huang ..... A63B 57/10 473/390
8,821,321 B2 * 9/2014 Chiang ..... A63B 69/3623 473/387
12,023,560 B2 * 7/2024 Rubac ..... A63B 57/19
2004/0185967 A1 * 9/2004 McDonough ..... A63B 57/10 473/387
2005/0003907 A1 * 1/2005 Ijiri ..... A63B 57/16 473/387
2005/0187041 A1 * 8/2005 Kawashima ..... A63B 57/16 473/387
2008/0070724 A1 * 3/2008 Elder ..... A63B 57/10 473/387
2009/0118041 A1 * 5/2009 Manson ..... A63B 57/10 473/387
2021/0016145 A1 * 1/2021 Ubale ..... A63B 57/10

FOREIGN PATENT DOCUMENTS

WO WO-2006004334 A1 * 1/2006 ..... A63B 57/10

* cited by examiner

*Primary Examiner* — Steven B Wong
(74) *Attorney, Agent, or Firm* — Saxton & Stump, LLC

(57) ABSTRACT

A golf tee comprising an air channel is described. The tee has a longitudinal axis and a perpendicular axis. The tee has an intake near the lower portion of the tee cup and a channel connects this intake to the tee cup itself such that air entering the intake of the tee is redirected to exit the tee though the tee cup along the longitudinal axis.

1 Claim, 9 Drawing Sheets

GOLF TEE WITH AIR CHANNEL

FIELD OF THE INVENTION

The present invention relates to golfing equipment, specifically golf tees.

BACKGROUND OF THE INVENTION

For years, golfing equipment manufacturers have been trying to battle the aerodynamics within the golf game. There is little that can be done when mother nature's weather and wind changes. However, most manufacturers who work with the basic components of golf—the ball, the golf tee, and the club itself—spend their research money constantly developing ways of curtailing wind resistance when it comes to the manufacturing of these key components in golf. Additionally, golfing equipment manufacturers continually are trying to design features on golf tees, golf balls, and golf clubs that bring benefits to the golfer.

Speaking specifically to the golf tee, inventors of golf tees have progressed from the very early wooden tee to the now popular wide head "almost indestructible" nylon-type golf tees. With injection molding being introduced to the golf tee world, almost any shape and style is able to be created. Beyond molded golf tees, manufacturers have developed ways to prop golf balls on top of light weight nylon bristles, rubber legs and rings, and many other substrates.

There seems to be consistency in three specific areas of golf tee production. First, for some golfers, the wider golf tee has become very popular. Who wouldn't want the ease of bending over and placing the golf ball on a wider than usual platform, so that the ball doesn't fall off? Some wide head golf tees can be close to 1" in diameter at the top. This is a far cry from the old standard golf head size of about one-half inch. Almost all golf tees try to conform to the United States Golf Association rules (but they do not necessarily have to conform, especially for non-professional golfers), which are very liberal when it comes to golf tee design. Under the USGA RULES a tee is a device designed to raise the ball off the ground and must not: be longer than 4 inches (101.6 mm); be designed or manufactured in such a way that it could indicate line of play; unduly influence the movement of the ball; or otherwise assist the player in making a stroke or in his play. Note: As an exception for difficult turf conditions, tees tethered together or to an anchor may be used during the round provided that the player does not align the tees or tether in such a way that could indicate line of play or otherwise assist the player in making a stroke.

Second, it is all about reducing friction! Golf tee manufacturers have done everything possible to reduce the friction of the golf ball on top of the golf tee. This includes placing the golf ball on points of the golf tee verses the entire rim of the golf tee. It also includes many materials that are considered to be friction resistant to the surface of the ball.

Third, it is about reducing club head air flow resistance when the club head approaches the ball and golf tee. Some manufacturers have gone so far as to place holes directly through the golf tee so as to allow some of the air pushed by the club to pass right through the tee, thus decreasing air resistance and enhancing the speed of the club as exemplified by the triple pronged cup of the Turf Tee™ by Zero Friction™. Others have tried to totally reduce the air flow by removing the front of the tee and the total bottom platform of the golf tee such as the dual pronged cup of the Senior Tee™ from ProActive Sports™.

BRIEF DESCRIPTION OF DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE INVENTION

Figure 1:
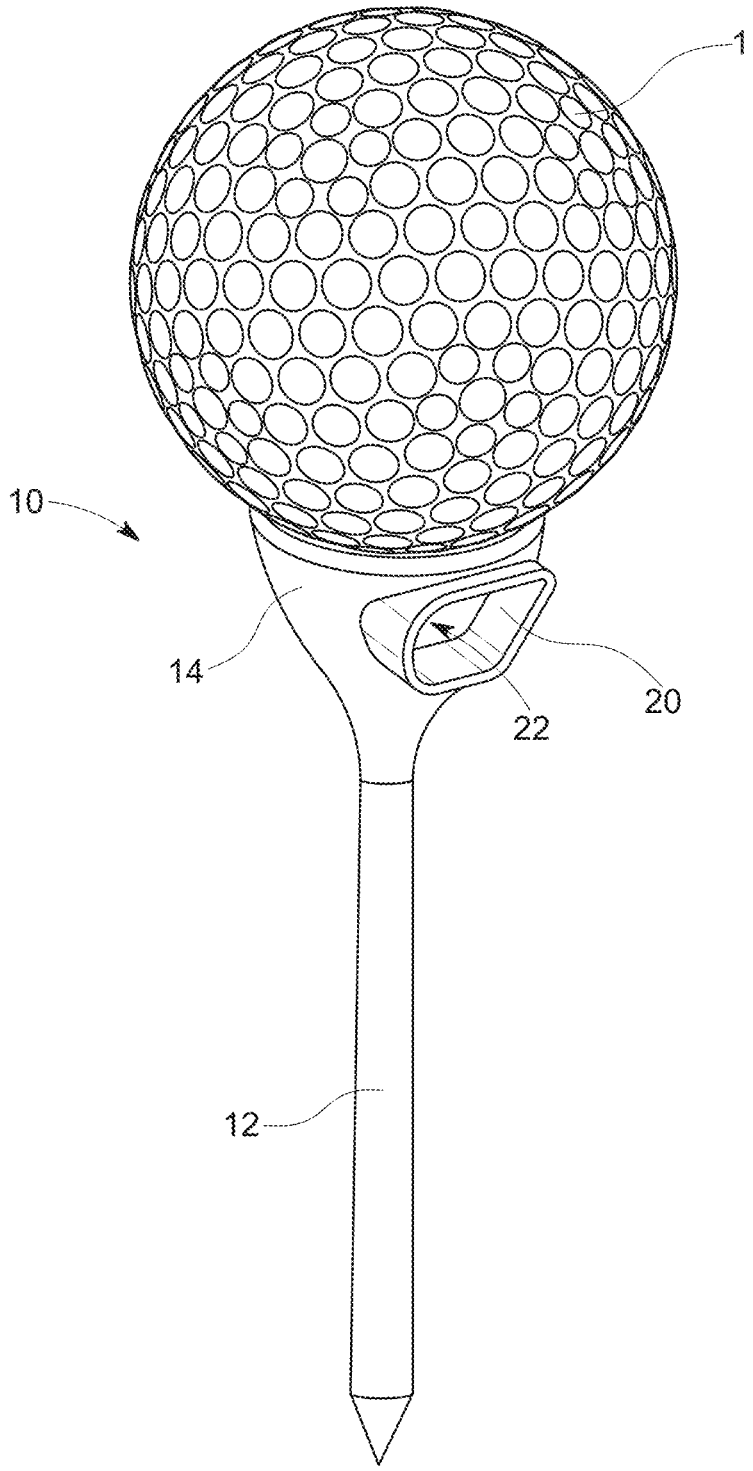
FIG. 1 is a perspective view of a golf tee with an air channel, supporting a golf ball, in accordance with embodiments of the present invention.
Figure 2:
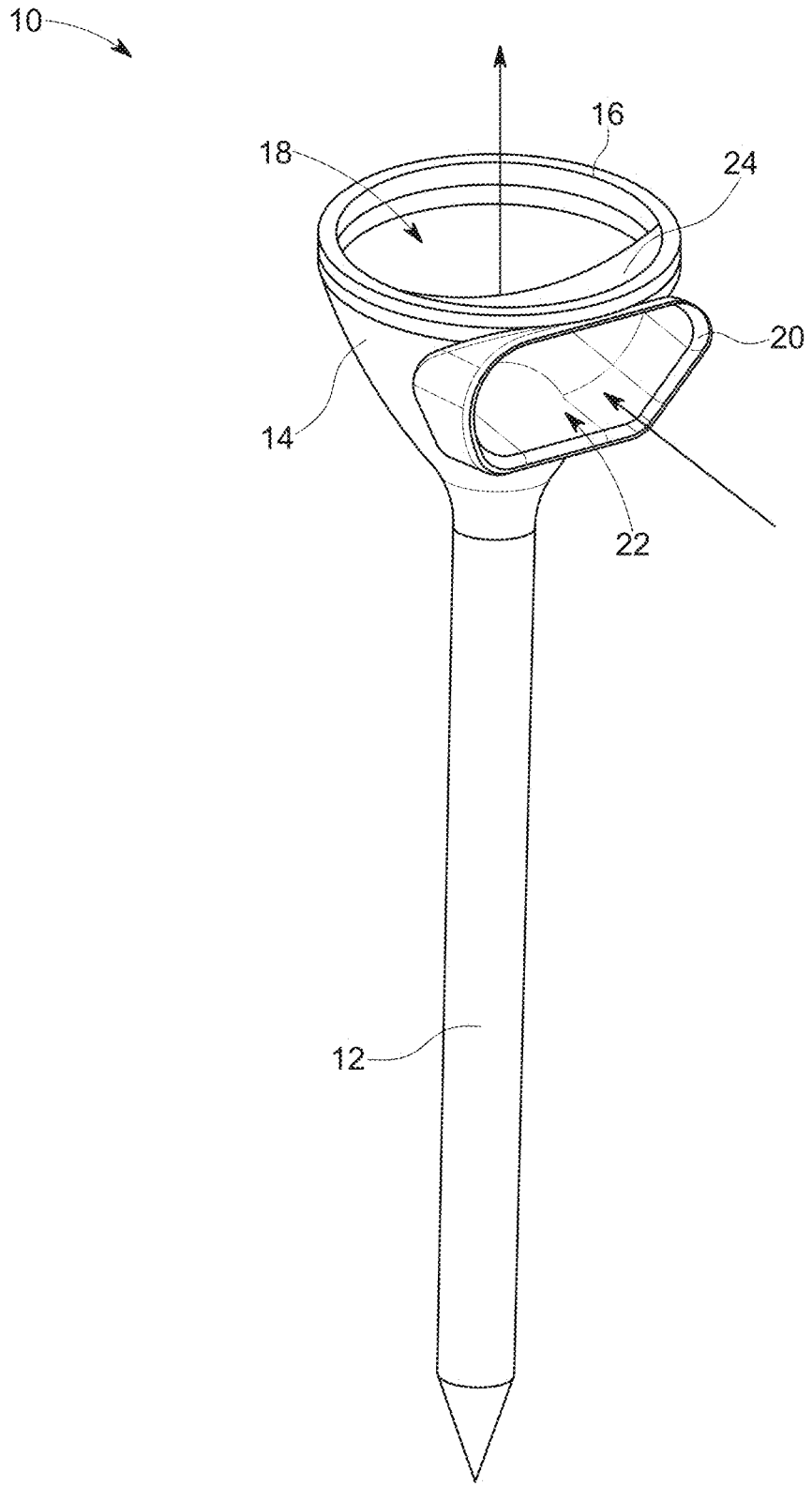
FIG. 2 is a perspective view of the golf tee of FIG. 1.
Figure 3:
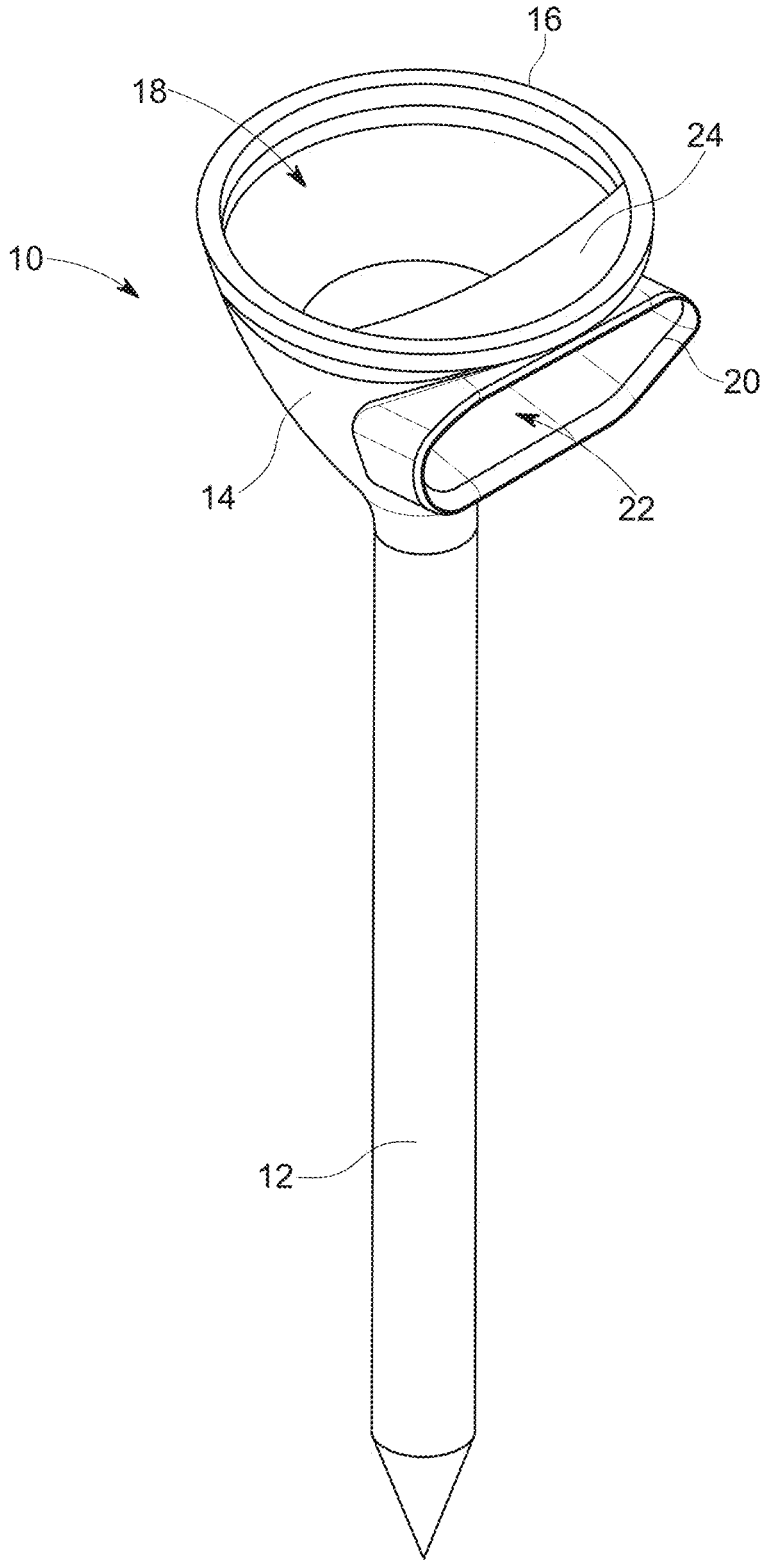
FIG. 3 is a perspective view of the golf tee of FIG. 1.
Figure 4:
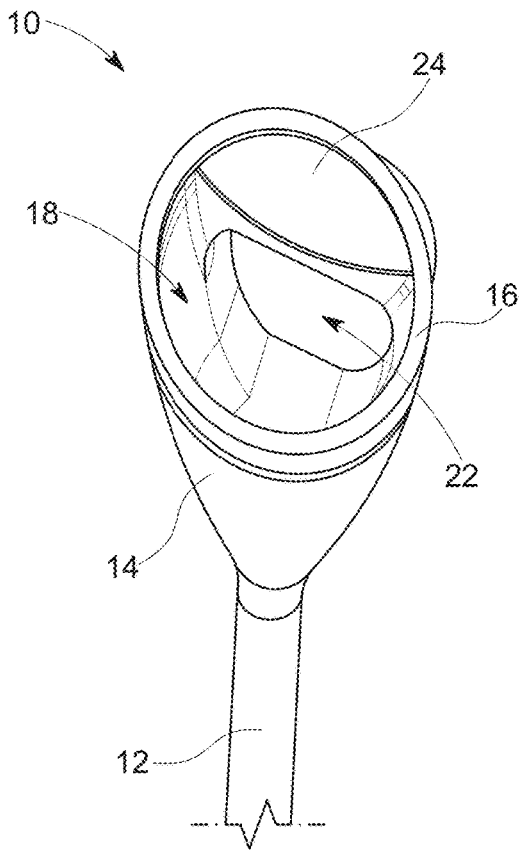
FIG. 4 is a close-up perspective view of the top of the golf tee of FIG. 1.
Figure 5:
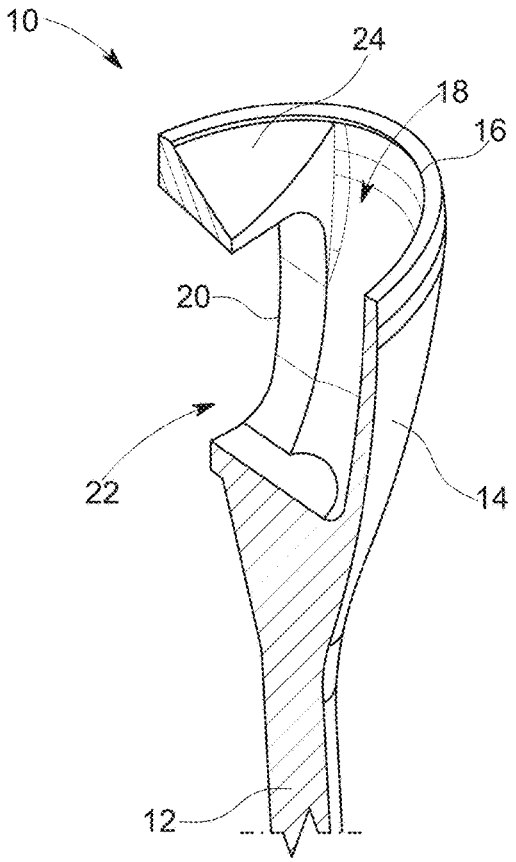
FIG. 5 is a close-up perspective sectional view of the top of the golf tee of FIG. 1.

Certain terminology is used in the following description for convenience only and is not limiting. The words "lower," "bottom," "upper," and "top" designate directions in the drawings to which reference is matte. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention comprise a novel golf tee that represents a total change in thinking. Rather than trying to reduce the air flow generated by the club head speed, it is our intention to capture the air flow generated by the golf club and to redirect the airflow first through one or more "circumferentially enclosed" openings in the front of the golf tee and then into a single chamber or perhaps into multiple chambers so as to increase the ball flight even further.

To accomplish this, an opening with an unbroken circumference in the front head of the golf tee and/or shaft leads to an air chamber. The air chamber may be formed entirely or partially by the cupped head of the tee (termed the tee cup) or may be formed by a separate structure positioned within (and likely affixed to) the tee cup (or a combination of both). Such additional structure, if present, may focus and direct the air flow in one or more desirable directions within and out of the tee cup. For example, the air may be directed upward and out of the tee cup around the perimeter of the tee cup, thereby forming a ring of air. As another example, the air may be directed upward and out of the tee cup at the center of the tee cup. An additional air chamber or throat may project outward from the tee cup. The throat has an unbroken opening and leads to the air chamber formed by or within the tee cup. Unlike the Senior Tee™ by Proactive Sports™, which allows more air to escape, the opening to the air chamber (and/or the opening of the throat) has a top (i.e., the opening has an unbroken perimeter) so that the air flow from the golf club head is better directed into the air chamber. The air flow captured within this air chamber can now be redirected upward, to the top, to the rear, or to the sides of the tee cup. This air redirection will reduce friction between the golf ball and the rim of the tee cup but can also ultimately impact the spin on the ball.

Referring now to the figures, FIGS. 1-5 shows a golf tee with an air channel in accordance with embodiments of the present invention. The golf tee 10 of embodiments of the invention comprises a shaft 12 and a tee cup 14 with a rim 16, as in a conventional golf tee. A golf ball 1 can sit on the rim 16 of the tee cup as seen in FIG. 1. Unlike a conventional golf tee in which the top surface of the tee cup has a fairly shallow concavity (typically just enough to accommodate the curvature of the golf ball as the golf ball sits on the rim), the tee cup 14 of the golf tee 10 of embodiments of the invention defines a larger, deeper chamber 18 (which may be termed an air chamber). An opening 22 is defined in the side wall of the tee cup 14 providing a pathway for air pushed toward the tee 10 by the face of a swinging golf club (not illustrated) into the air chamber 18. The opening 22 of the golf tee 10 is defined by an optional throat 20 that projects outward from the side wall of the tee cup 14. The optional throat improves the channeling of the pushed air into the air chamber. Notably, the perimeter of the opening 22 (whether the optional throat is present or not) is continuous or unbroken. Similarly, the rim 16 is continuous or unbroken. In this regard, the air pushed by the golf club (indicated by the two red arrows in FIG. 2) that enters the opening 22 goes into the air chamber 18 and is forced upward and out of the air chamber 18 through the top rim 16. This channeled and controlled air flow is in contrast to the unchanneled and uncontrolled air flow through and around a discontinuous rim, such as in the Senior Golf Tee™ by Proactive Sports™M. This airflow exiting through the rim 16 causes the golf ball to raise up slightly, thereby reducing the friction between the golf ball 1 and the rim 16. A small (optional) concave shelf 24 spans a portion of the rim 16 to provide additional strength and rigidity to the tee cup 14. The concavity of the shelf 24 is typically similar to the concavity of the top surface of the tee cup of a conventional golf tee.

Figure 6:
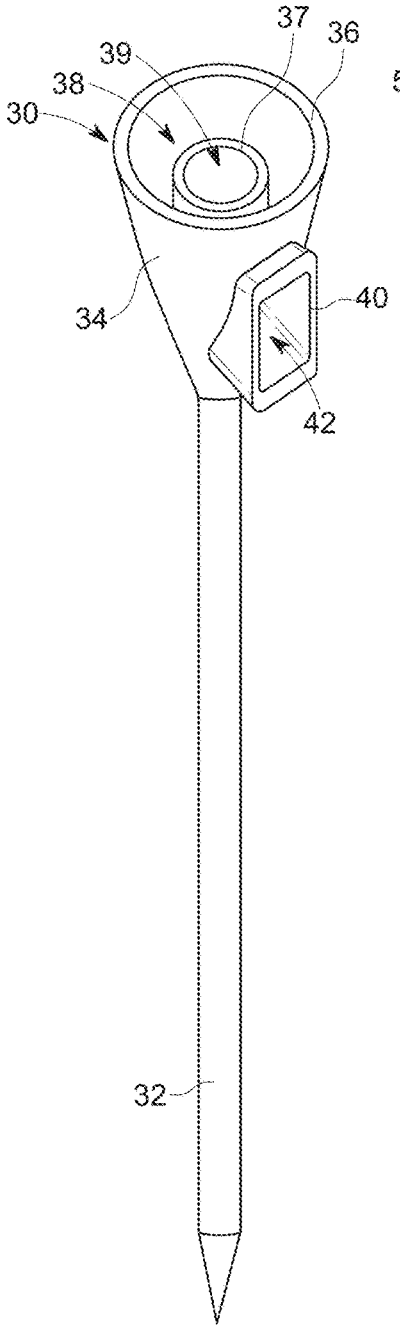
FIG. 6 is a perspective view of a golf tee with an air channel, in accordance with alternative embodiments of the present invention.

FIG. 6 shows a golf tee with an air channel in accordance with alternative embodiments of the present invention. The golf tee 30 of FIG. 6 comprises a shaft 32 and a tee cup 34 with an outer rim 36. A golf ball (not illustrated) can sit on the outer rim 36. The tee cup 34 of the golf tee 30 defines a chamber 38. An additional, lower central rim 37 defines a central chamber 39 that is surrounded by the chamber 38. The rim 37 is lower than the rim 36 to accommodate the curvature of the golf ball when the golf ball sits on the outer rim 36. An opening 42 in the side wall of the tee cup 14 defined by a throat 40 projecting outward from the side wall of the tee cup 14 provides a pathway for air pushed toward the tee 30 by the face of a swinging golf club (not illustrated). Although not illustrated, there may be a connection between the opening 42 and the chamber 38 (providing a halo or ring of air pushing upward), between the opening 42 and the chamber 39 providing a central column of air pushing upward), or between the opening 42 and both chamber 38 and chamber 39 (providing both a ring of air and a central column of air pushing upward). As with the golf tee 10 of FIGS. 1-5, the perimeter of the opening 42 (whether the optional throat is present or not) is continuous or unbroken and the outer rim 36 is continuous or unbroken. In this regard, the air pushed by the golf club that enters the opening 42 either (1) goes into the air chamber 38 and is forced upward and out of the air chamber 38 through the space between the outer rim 36 and the inner rim 37, (2) goes into the air chamber 39 and is forced upward and out of the air chamber 39 through the inner rim 37, or (3) goes into the air chamber 38 and is forced upward and out of the air chamber 38 through the space between the outer rim 36 and the inner rim 37 and goes into the air chamber 39 and is forced upward and out of the air chamber 39 through the inner rim 37.

Figure 7:
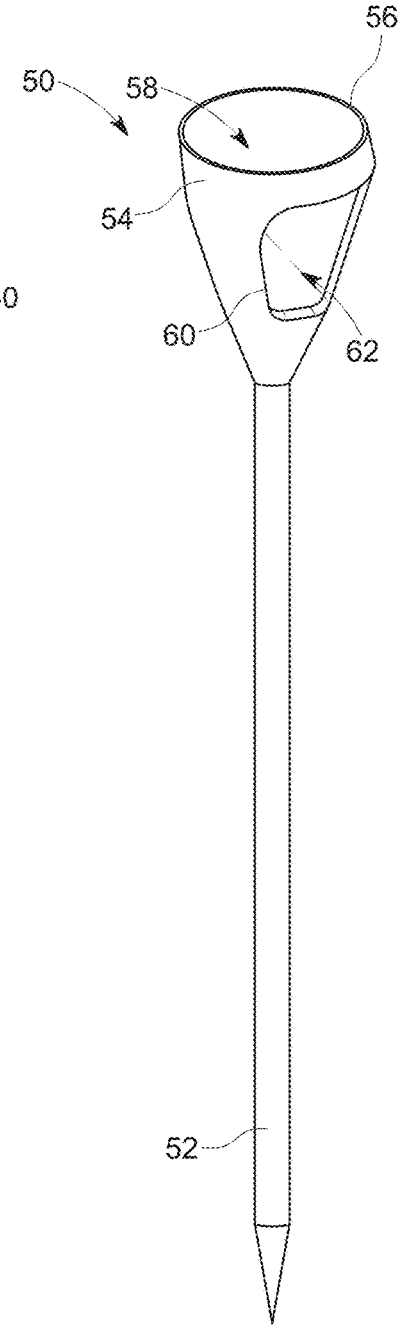
FIG. 7 is a perspective view of a golf tee with an air channel, in accordance with alternative embodiments of the present invention.

FIG. 7 shows a golf tee with an air channel in accordance with alternative embodiments of the present invention. The golf tee 50 of FIG. 7 comprises a shaft 52 and a tee cup 54 with a rim 56. A golf ball (not illustrated) can sit on the rim 56. The tee cup 54 of the golf tee 50 defines an air chamber 58. An opening 62 in the side wall of the tee cup 54 defined by a perimeter 60 provides a pathway for air pushed toward the tee 50 by the face of a swinging golf club (not illustrated). As with the golf tee 10 of FIGS. 1-5, the perimeter 60 of the opening 62 is continuous or unbroken and the rim 56 is continuous or unbroken. In this regard, the air pushed by the golf club that enters the opening 62 goes into the air chamber 58 and is forced upward and out of the air chamber 58 through the rim 56.

Figure 8:
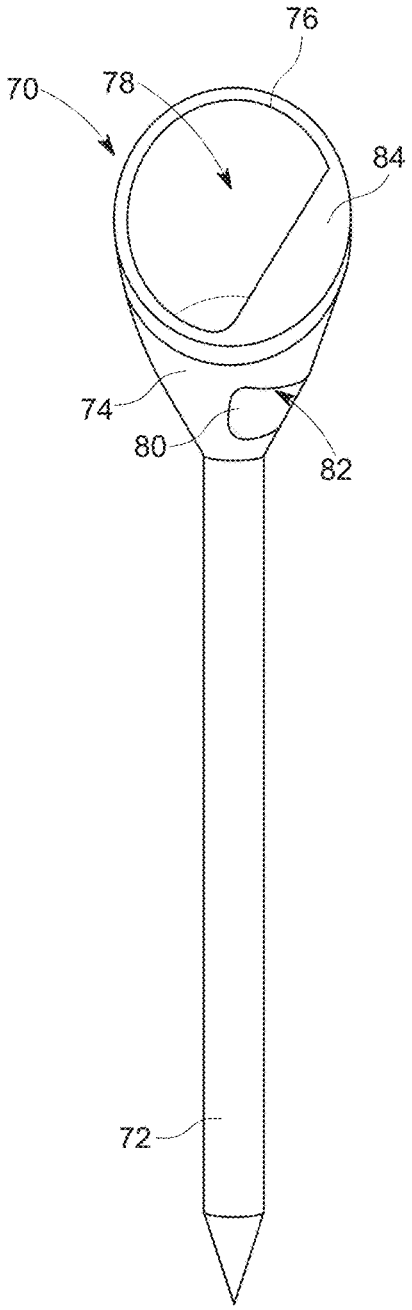
FIG. 8 is a perspective view of a golf tee with an air channel, in accordance with alternative embodiments of the present invention.

FIG. 8 shows a golf tee with an air channel in accordance with alternative embodiments of the present invention. The golf tee 70 of FIG. 8 comprises a shaft 72 and a tee cup 74 with a rim 76. A golf ball (not illustrated) can sit on the rim 76. The tee cup 74 of the golf tee 70 defines a chamber 78. An opening 82 in the side wall of the tee cup 74 defined by a perimeter 80 provides a pathway for air pushed toward the tee 70 by the face of a swinging golf club (not illustrated). As with the golf tee 10 of FIGS. 1-5, the perimeter 80 of the opening 82 is continuous or unbroken and the rim 76 is continuous or unbroken. In this regard, the air pushed by the golf club that enters a terminus of the opening 82 goes into the air chamber 78 and is forced upward and out of the air chamber 78 through a terminus of the rim 76. A small concave shelf 84 spans a portion of the rim 76 to provide additional strength and rigidity to the tee cup 74. The concavity of the shelf 84 is similar to the concavity of the top surface of the tee cup of a conventional golf tee.

Figure 9:
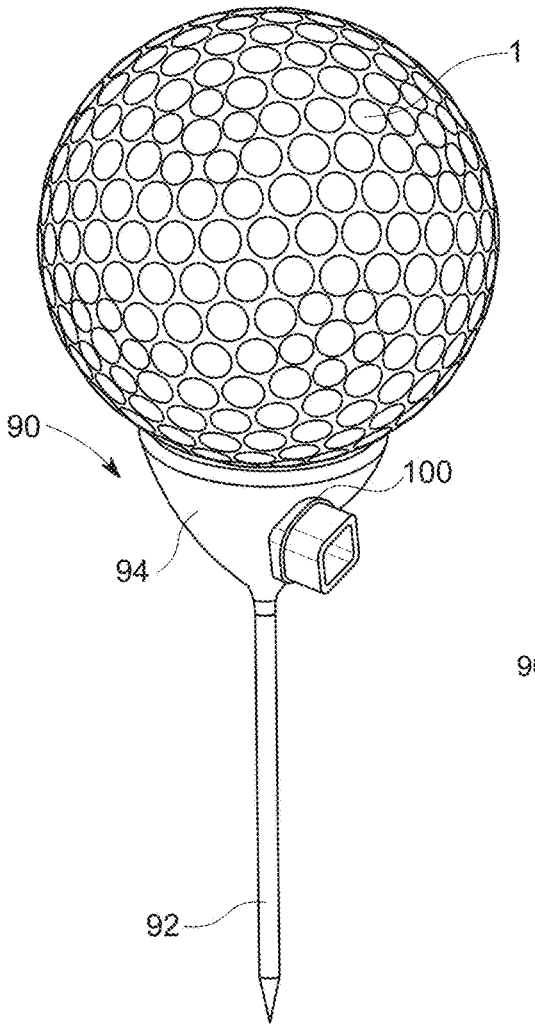
FIG. 9 is a perspective view of a golf tee with an air channel, supporting a golf ball, in accordance with alternative embodiments of the present invention.
Figure 10:
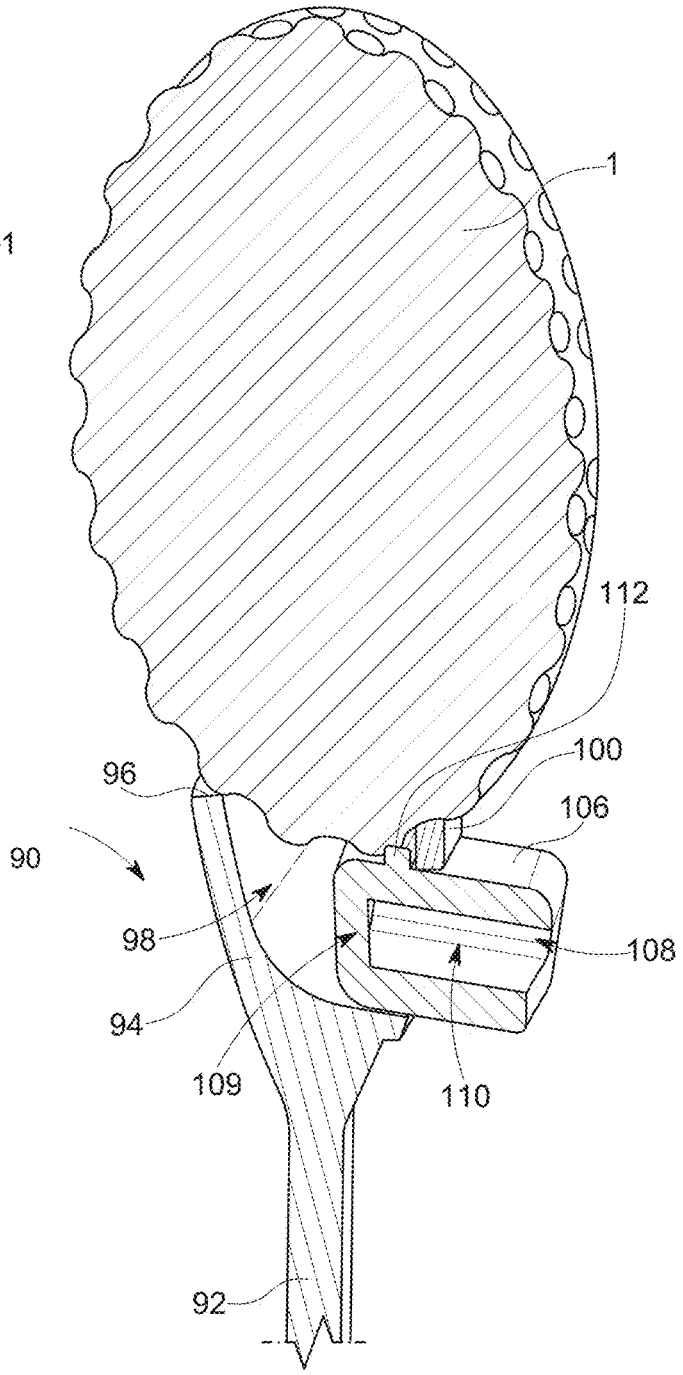
FIG. 10 is a close-up perspective sectional view of the top of the golf tee of FIG. 9, supporting a golf ball.

FIGS. 9 and 10 show a golf tee with an air channel in accordance with alternative embodiments of the present invention. The golf tee 90 of FIGS. 9 and 10 comprises a shaft 92 and a tee cup 94 with a rim 96. A golf ball 1 can sit on the rim 96. The tee cup 94 of the golf tee 90 defines a chamber 98. An opening (unlabeled) in the side wall of the tee cup 94 is defined by a defined by a throat 100 projecting outward from the side wall of the tee cup 94. An elongated thrusting device 106 is slidably mounted within the throat 100. The thrusting device 106 defines a through-hole 110 with a proximal opening 108 and a distal opening 109. The through-hole 110 of the thrusting device 106 provides a pathway for air pushed toward the tee 90 by the face of a swinging golf club (not illustrated) (this air pathway through the thrusting device 106 is narrower than the air pathway through the throat without the thrusting device, thereby providing a higher air pressure into the air chamber with the thrusting device than without). In this regard, the air pushed by the golf club that enters the proximal opening 108 of the thrusting device 106 goes into the air chamber 98 and is forced upward and out of the air chamber 98 through the rim 96. When the proximal end of the thrusting device 106 is struck by the golf club, the thrusting device 106 is pushed further into the chamber 98 which increases the air pressure within the chamber 98 to further force air upward and out of the air chamber 98 through the rim 96. An upward protrusion 112 near the distal end of the thrusting device 106 may have a dual purpose. The protrusion 112 may help retain the thrusting device 106 within the throat 100. Additionally, the protrusion may contact and push up the golf ball 1 when the thrusting device slides further into the chamber 98 when struck by the golf club, thereby further assisting the lifting of the golf ball 1. In alternative embodiments of the invention, the thrusting device may (1) have a closed-off proximal end, (2) have a closed-off distal end, or (3) may be solid.

Embodiments of the invention may comprise a golf tee having a tee cup of many different sizes, which may affect the air flow in various ways.

Figure 11:
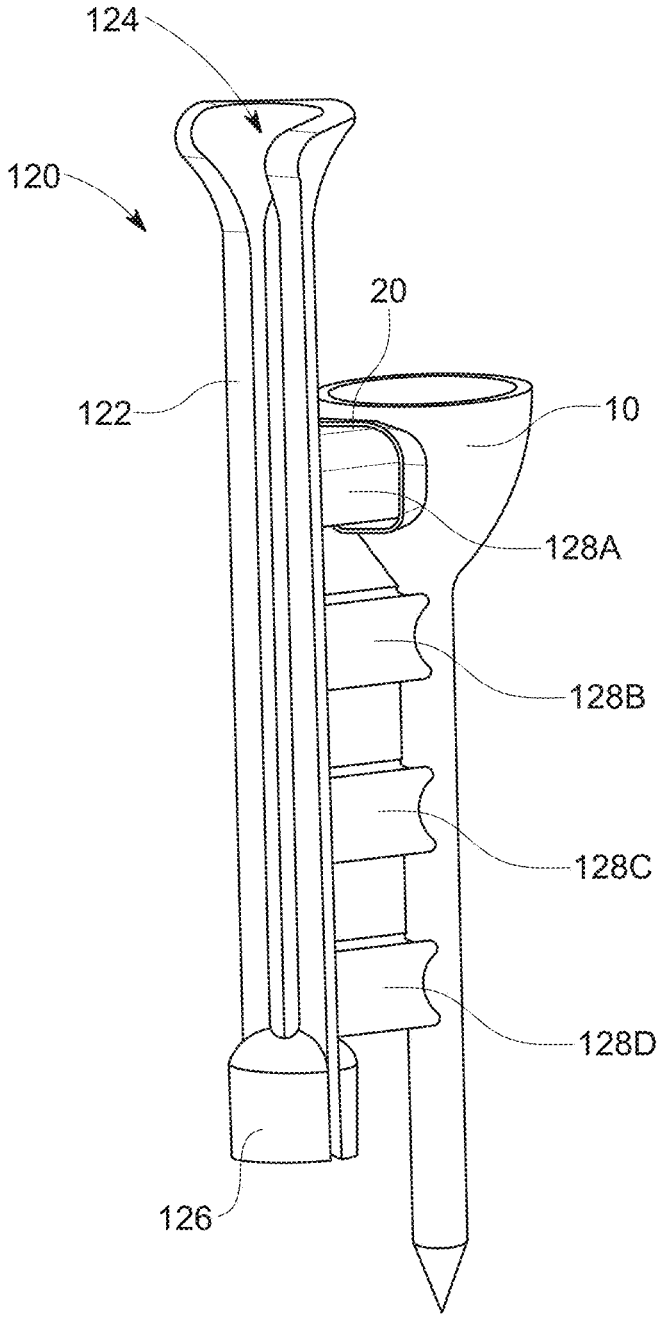
FIG. 11 is a perspective view of a golf tee holding and positioning device, in use with the golf tee of FIG. 1, in accordance with alternative embodiments of the present invention.

FIG. 11 shows a golf tee holding and positioning device, in use with the golf tee of FIG. 1. The golf tee holding and positioning device 120 may be used to hold a golf tee when the tee is not needed and to help set the height of the golf tee for teeing off. The device 120 comprises an elongated main body 122 defining an elongated chamber with a flared opening 124. When not in use, a golf tee (such as tee 10) may be inserted into the chamber of the device 120 by inserting the tee's shaft 12 through the flared opening 124 and pushing the tee down until the tee is retained in the device via a friction fit (while a friction fit is used to secure the device 120 to the golf tee, the amount of friction and therefore the force needed to separate the device 120 from the golf tee should be fairly low such that separating the device 120 from the golf tee does not cause undesirable movement of the golf tee). The tee may be readily removed from the chamber of the device 120 simply by grasping the tee cup and pulling in the direction of the flared opening 124. The distal end of the device may comprise an attachment mechanism 126 for releasably attaching the device to, e.g., a golfer's belt or golf bag using a clip or the like (not illustrated). The attachment mechanism 126 may comprise a magnet, a snap, a friction-fit opening, or any other suitable mechanism for releasably attaching the device 120 to such a clip or the Ilke. Likewise, the opening in the tee cup of the golf tee of embodiments of the invention may be used to attach the golf tee to a golfer's belt, golf bag, or the like using a clip or the like (not illustrated). The clip (or the like) would have a protrusion similar to the protrusions of the device 120. The opening in the tee cup would be pushed onto the protrusion such that the golf tee is retained via a friction fit (or other mechanism) until the golfer pulls the golf tee off the protrusion (this protrusion would be slightly larger than the protrusions of the device 120 to ensure a more secure friction fit).

A plurality of protrusions 128A-D (four are illustrated, although fewer or more protrusions could be present) project perpendicularly outward from the main body 122. Each of the plurality of protrusions 128A-D is selectively insertable into the throat 20 of the tee 10 to retain the tee 10 in one of a plurality of different positions relative to the device 120. Each position corresponds to a different tee height when the tee is pushed into the ground for teeing off. The distal ends of at least the bottom three protrusions (128B-D in the illustrated embodiment) are curved to engage the shaft of the tee for stability when inserting the tee into the ground. Attaching the tee 10 to protrusion 128A would set the tee height at its highest position, while attaching the tee 10 to protrusion 128D would set the tee height at its lowest position. The spacing and position of the protrusions may be selected to correspond to typical desired tee heights (which typically vary based on the golf club to be used). In use, the golfer attaches the golf tee to the one of the protrusions 128A-D that corresponds to the desired tee height. The golfer then pushes the tee into the ground until the bottom end of the device 120 (which is the attachment mechanism 126 in the illustrated embodiment) touches the ground, at which point the tee is at the desired height. The golfer may then detach the device 120 from the tee 10 and tee off.

Figure 12:
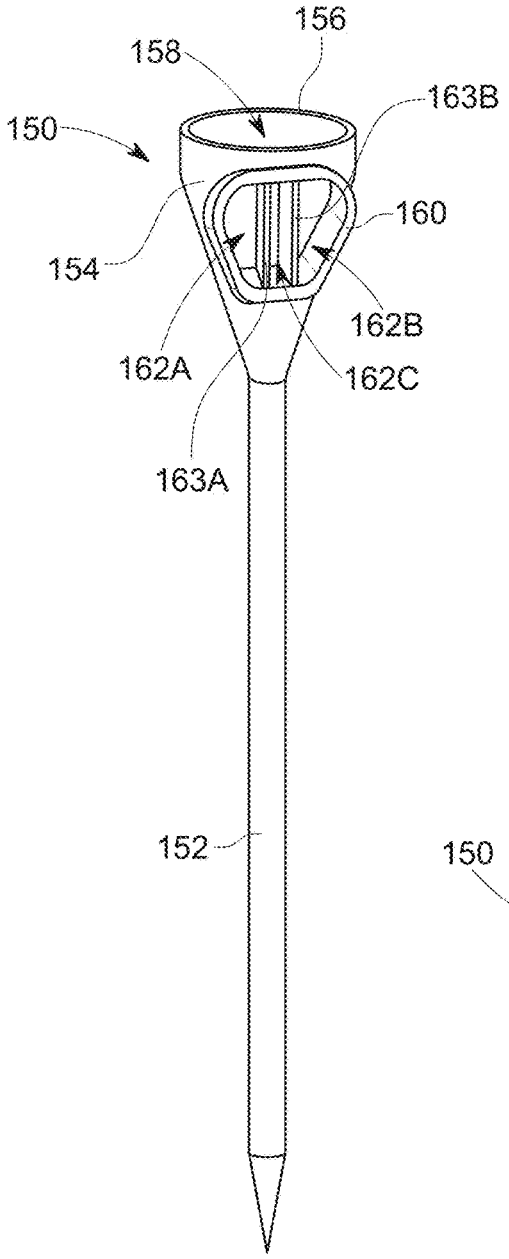
FIG. 12 is a perspective view of a golf tee with an air channel, in accordance with alternative embodiments of the present invention.
Figure 13:
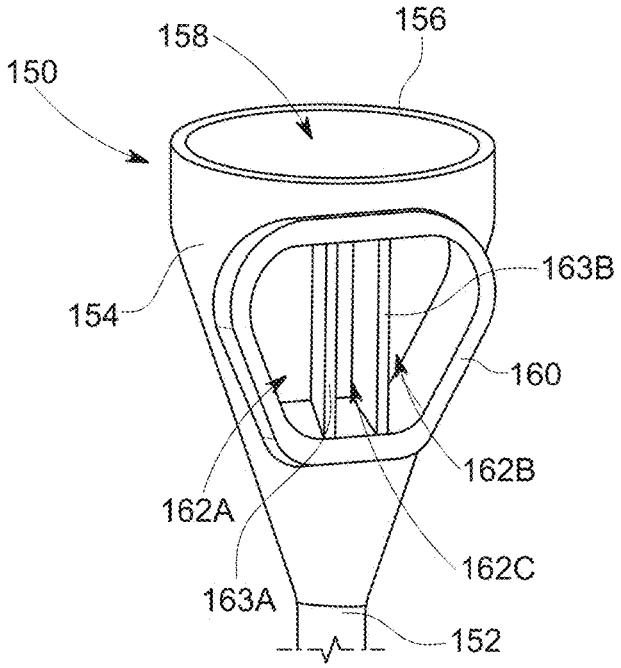
FIG. 13 is a close-up perspective view of the top of the golf tee of FIG. 12.
Figure 14:
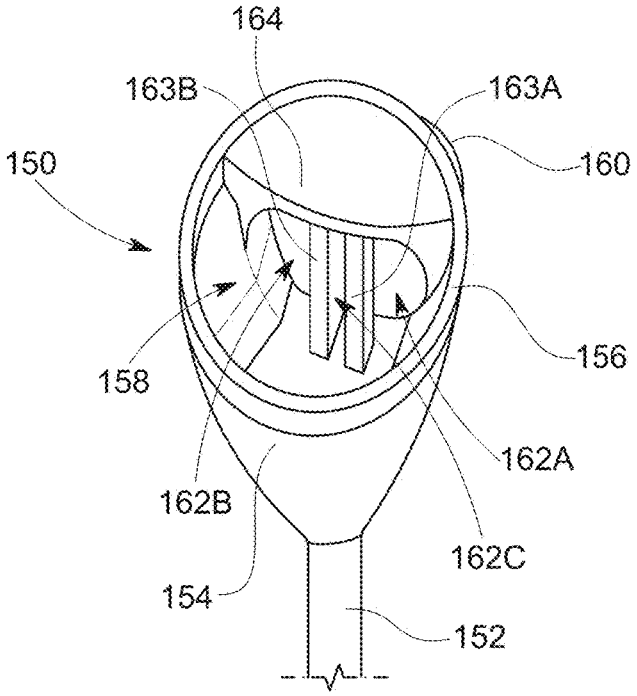
FIG. 14 is a close-up perspective view of the top of the golf tee of FIG. 12, from a different angle.

In some embodiments of the invention, the air chamber(s) may be structured to produce a noise (e.g., a whistling sound) when the golf club swing drives air into/through the chamber. The intensity of the noise may correspond to the amount of air, and thus may function as a feedback mechanism to indicate that air is properly being introduced into/through the chamber. FIGS. 12-14 show a golf tee with an air channel in accordance with alternative embodiments of the present invention. The golf tee 150 of FIGS. 12-14 comprises additional structure to provide a whistle or noise-making function. The golf tee 150 of FIG. 12-14 comprises a shaft 152 and a tee cup 154 with a rim 156. A golf ball (not illustrated) can sit on the rim 156. The tee cup 154 of the golf tee 150 defines a chamber 158. An opening in the side wall of the tee cup 154 defined by a throat 160 provides a pathway for air pushed toward the tee 150 by the face of a swinging golf club (not illustrated). Notably, two roughly vertical walls 163A, 163B divide the opening defined by the throat 160 into three sub-openings 162A, 162B, 162C. The walls 163A, 163B are fairly close together such that the center sub-opening 162C is fairly narrow and a fairly narrow air channel is created between the walls 163A, 163B. This narrow sub-opening 162C and narrow channel cause a whistling noise as air pushed by the golf club passes through the narrow channel between the walls 163A, 163B. As with the golf tee 10 of FIGS. 1-5, the throat 160 of the opening is continuous or unbroken and the rim 156 is continuous or unbroken. In this regard, the air pushed by the golf club that enters the sub-openings 162A, 162B, 162C goes into the air chamber 158 and is forced upward and out of the air chamber 158 through the rim 156. A small concave shelf 164 spans a portion of the rim 156 to provide additional strength and rigidity to the tee cup 154. The concavity of the shelf 164 is similar to the concavity of the top surface of the tee cup of a conventional golf tee.

Figure 15:
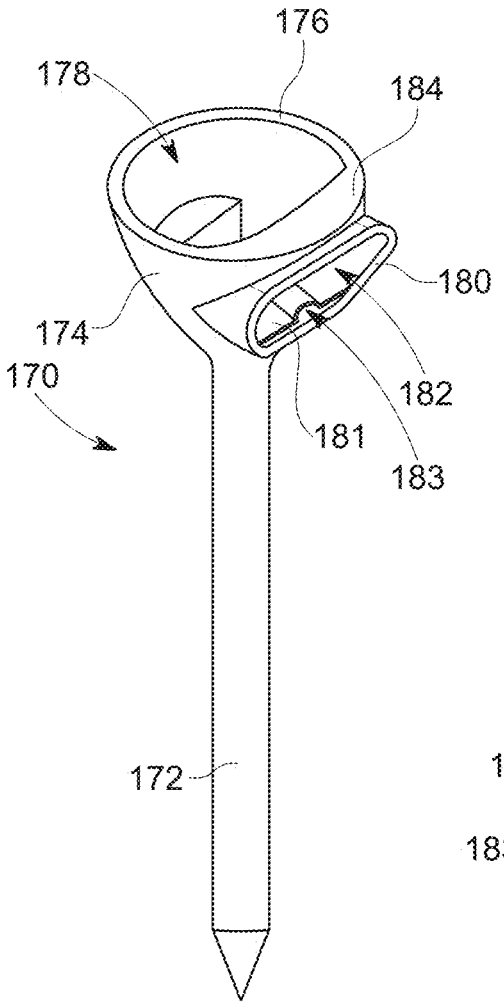
FIG. 15 is a perspective view of a golf tee with an air channel, in accordance with alternative embodiments of the present invention.
Figure 16:
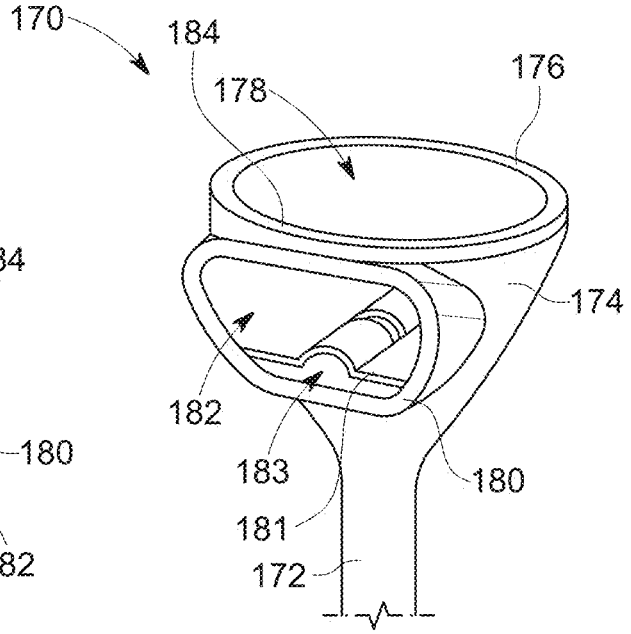
FIG. 16 is a close-up perspective view of the top of the golf tee of FIG. 15.
Figure 17:
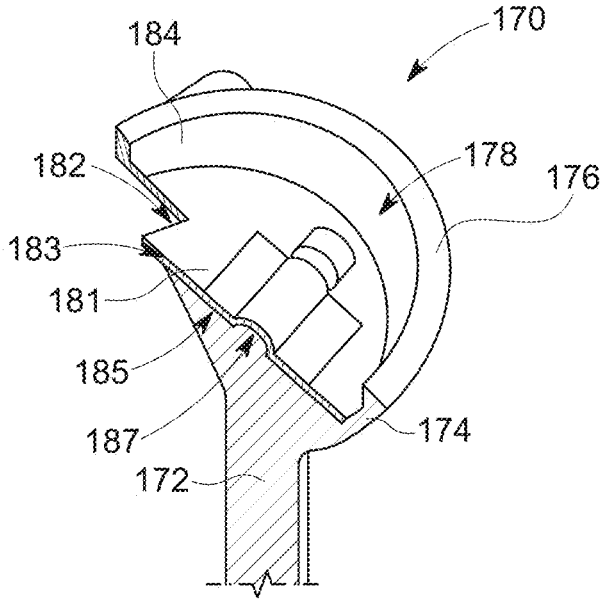
FIG. 17 is a close-up perspective sectional view of the top of the golf tee of FIG. 15

FIGS. 15-17 show a golf tee with an air channel in accordance with alternative embodiments of the present invention. The golf tee 170 of FIGS. 15-17 comprises additional structure to provide a whistle or noise-making function. The golf tee 170 of FIG. 15-17 comprises a shaft 172 and a tee cup 174 with a rim 176. A golf ball (not illustrated) can sit on the rim 176. The tee cup 174 of the golf tee 170 defines a chamber 178. An opening in the side wall of the tee cup 174 defined by a throat 180 provides a pathway for air pushed toward the tee 170 by the face of a swinging golf club (not illustrated). Notably, a roughly horizontal shelf 181 (likely with an upward deflection, as shown) divides the opening defined by the throat 180 into two sub-openings 182, 183. The shelf 181 is fairly low within the throat 180 such that sub-opening 183 is fairly narrow and such that a fairly narrow air channel 185 is created by the shelf 181. The air channel 185 has a distal opening 187 through which air exits the air channel 185 into the chamber 178. This narrow opening 183 and narrow channel cause a whistling noise as air pushed by the golf club passes through the narrow opening 183, through the narrow air channel 185, and out the distal opening 187. As with the golf tee 10 of FIGS. 1-5, the throat 180 of the opening is continuous or unbroken and the rim 176 is continuous or unbroken. In this regard, the air pushed by the golf club that enters the sub-openings 182, 183 goes into the air chamber 178 and is forced upward and out of the air chamber 178 through the rim 176. (Because of the relative sizes of the sub-openings 182, 183, more of the air that is pushed by the golf club goes through sub-opening 182 than goes through sub-opening 183. However, both components of the air flow enter the air chamber 178 and contribute to the air pressure against the golf ball. A small concave shelf 184 spans a portion of the rim 176 to provide additional strength and rigidity to the tee cup 174. The concavity of the shelf 184 is similar to the concavity of the top surface of the tee cup of a conventional golf tee.

The concave shelf shown in some of the embodiments of the invention is optional. If present, the shelf may have a different structure than what is illustrated. For example, the shelf may be planar or have a different curvature than is illustrated. The shelf may have one or more holes defined in it to allow air flow through the shelf. The shelf may be shaped to alter or direct the air flow through the tee cup. Instead of a shelf, a beam or the like may be used to provide rigidity to the tee cup.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A golf tee with a channel is comprised of a shaft, a tee cup, a longitudinal axis, and a perpendicular axis, the shaft has an upper bound and a lower terminus, the tee cup comprises a lower bound, whereas the upper bound of the shaft and the lower bound of the tee cup are continuous, said tee cup further comprises a wall having an inner surface and an outer surface, a rim, an intake, an exhaust, and a channel, said rim being continuous, said intake being defined by a single opening in the wall of the tee cup, an inner face defining the channel, said channel comprises a first portion, approximately parallel to the perpendicular axis of the golf tee, and a second portion approximately parallel to the longitudinal axis of the tee, whereas, the first portion of the channel comprises a first portion terminus located at the intake whereas, the second portion of the channel comprises a second portion terminus located at the rim of the tee cup, whereas the tee cup and the intake are in communication through the channel.

* * * * *